US005856816A

United States Patent [19]

Youn

[11] Patent Number: 5,856,816

[45] **Date of Patent: *Jan. 5, 1999**

[54] DATA DRIVER FOR LIQUID CRYSTAL DISPLAY

[75] Inventor: Hee Gyung Youn, Seoul, Rep. of Korea

[73] Assignee: LG Electronics Inc., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 542,650

[22] Filed: Oct. 13, 1995

[30] Foreign Application Priority Data

Jul. 4, 1995 [KR] Rep. of Korea ..... 1995-19513

[51] Int. Cl.[6] ..... G09G 3/36

[52] U.S. Cl. ..... 345/98; 345/96; 345/103

[58] Field of Search ..... 345/96, 98–100, 345/103, 205, 206

[56] References Cited

U.S. PATENT DOCUMENTS

| | | | |
|---|---|---|---|
| 4,447,812 | 5/1984 | Soneda et al. | 340/784 |
| 4,736,137 | 4/1988 | Ohwada et al. | 315/169.3 |
| 4,745,485 | 5/1988 | Iwasaki | 358/236 |
| 4,870,399 | 9/1989 | Carlson | 345/100 |
| 4,965,566 | 10/1990 | Kawamura et al. | 345/147 |
| 5,093,655 | 3/1992 | Tanioka et al. | 345/96 |
| 5,298,912 | 3/1994 | Mano et al. | 345/88 |
| 5,369,417 | 11/1994 | Tanaka | 345/98 |
| 5,440,323 | 8/1995 | Okada | 345/100 |

FOREIGN PATENT DOCUMENTS

| | | |
|---|---|---|
| 0 244 978 | 11/1987 | European Pat. Off. . |
| 0 261 901 | 3/1988 | European Pat. Off. . |
| 0 740 284 | 10/1996 | European Pat. Off. . |
| 43 22 666 | 1/1994 | Germany . |
| 1248195 | 10/1989 | Japan . |
| 2000088 | 1/1990 | Japan . |
| 2216190 | 8/1990 | Japan . |
| 4-46386 | 2/1992 | Japan . |
| 4237090 | 8/1992 | Japan . |

*Primary Examiner*—Jeffery Brier
*Attorney, Agent, or Firm*—Loeb & Loeb LLP

[57] ABSTRACT

A data driver includes a first signal generating circuit for externally producing a start signal; a second signal generating circuit for externally producing a first clock signal; a third signal generating circuit for externally producing a load signal; a generator externally generating a source video signal having a frequency; and a single integrated circuit including: an m-bit register circuit for receiving the start signal corresponding to the first clock signal and outputting a latch clock signal, where m is an integer; a data latch circuit for latching and outputting at least two sets of three video signals corresponding to the source video signal, the data latch circuit receiving all of the video signals simultaneously, each of the video signals having n-bits of data, where n is an integer; a line latch circuit for latching the video signals from the data latch circuit corresponding to the latch clock signal from the shift register, the line latch circuit storing and outputting the video signal according to the load signal of the third signal generation circuit; a digital to analog converter circuit for converting the video signal from the line latch to an analog signal; and a data output circuit for outputting the analog signal from the digital to analog converter, where a frequency of the first clock signal is reduced by the number of sets of the three video signals as compared to a frequency of the source video signal.

20 Claims, 6 Drawing Sheets

DATA DRIVER FOR LIQUID CRYSTAL DISPLAY

BACKGROUND OF THE INVENTION

1. Field of the Invention

The present invention relates to a driver, and more particularity, to a data driver for a liquid crystal display.

2. Discussion of the Related Art

Referring to FIG. 1, a general active matrix liquid crystal display includes a lower substrate on which gate lines G1–Gn, data lines D1–Dn, a thin film transistor for switching pixels, and a pixel electrode are arranged. An upper substrate has a color filter for displaying colors and a common electrode. A liquid crystal panel 1 has a liquid crystal filled between the two upper and lower substrates, and a gate driver 2 sequentially applies driving signals to respective gate lines G1–Gn of liquid crystal panel 1. A data driver 3 applies video data to respective data lines D1–Dn of liquid crystal panel 1.

In such a liquid crystal display, liquid crystal panel 1 is becoming larger and with higher resolution. In order to drive larger and higher-resolution liquid crystal displays, the driving frequency of respective drivers 2 and 3 becomes higher. However, it is difficult to develop a driver IC capable of directly driving such a high frequency. Even though the driver IC capable of directly driving the high frequency may be developed, direct driving is not feasible due to high-frequency EMI. For this reason, as shown in FIG. 2, a data driver is provided on both sides of liquid crystal panel 1 according to two separate even and odd lines so that the driving frequency is reduced by half.

In the liquid crystal display of FIG. 2, however, because the driver is formed on both sides, the area of the liquid crystal panel for displaying actual images becomes smaller in the overall liquid crystal display. This limits the obtaining of a large-sized screen. The data driver of the conventional liquid crystal display of FIG. 1 will be discussed with reference to FIG. 3.

The data driver of the conventional liquid crystal display includes an m-bit shift register 11 for shifting a source start pulse SSP by a source pulse clock SCL and outputting a latch clock. A data latch 12 latches and outputs three signals DA(n), DB(n), and DC(n) of display data by source clock SCL. A line conversion logic 14 converts the polarity for every horizontal period by an external POL signal for the purpose of inversion. A 3m-by-n-bit two-line latch 13 latches, by lines, all display data of one horizontal line output from data latch 12 by the latch clock output from shift register 11 according to an external load signal and the output of line conversion logic 14. A D/A converter 15 selects and outputs one voltage of $2^n$ levels formed by an external reference voltage so as to convert the data output from line latch 13 into an analog signal to be applied to the liquid crystal. A data output circuit 16 amplifies the signal output from D/A converter 15 to a stable voltage having a sufficient driving capability and a less-deviation output voltage. The amplified signal is output to the liquid crystal.

The operation of the conventional data driver will be described below with reference to FIG. 4. First, shift register 11 receives source clock SCL and source start pulse SSP, and outputs m latch clocks SR01, SR02, SR03, . . . , and SR0m (m=64) sequentially to line latch 13. Source clock SCL is a clock signal of about 65 MHz in XGA. The R/L input is a shift right/left input that informs the mBIT shift register 11 to shift right or left.

Data latch 12 latches signals DA(n), DB(n), and DC(n) of the n-bit display data corresponding to the falling edge of source clock SCL, and outputs the latched result to line latch 13. Line latch 13 latches the n-bit display data latched to the falling edge of the source clock to 3m-by-n bit first line latch portion 13*a* by latch clocks SR01, SR02, SR03, . . . , and SR0m output from shift register 11. After one horizontal line of display data is stored, one line data is stored in second line latch portion 13*b* at one time by an external load signal LOAD. Simultaneously, the next line data is latched to first line latch portion 13*a* by latch clocks SR01, SR02, SR03, . . . , and SR0m output from shift register 11 in the same method as above. This operation is performed repeatedly.

The line data stored by line latch 13 is output to D/A converter 15. D/A converter 15 selects and outputs, from the $2^n$ levels formed by an external reference voltage $v_{REF}$ in an internal decoder, one voltage corresponding to the line data input from line latch 13. Here, line conversion logic 14 converts the polarity for every line by the external POL signal to facilitate the inversion.

The analog signal selected and output from D/A converter 15 is applied and displayed to the liquid crystal as a stable voltage having a sufficient driving capability and less-deviation output voltage. The conventional data driver, however, has the following drawbacks.

With the trend of larger screens and higher resolution, the hardest obstacle in the application of liquid crystal displays to liquid crystal laptop computers and their monitors is the operation frequency (65 MHz for XGA and 107 MHz for EWS) in accordance with resolution. The operation frequency of the conventional IC data driver is 55 MHz at 5 V driving (40 MHz at 3.3 V). Hence, the driver cannot be driven directly. Even when a directly drivable driver IC is developed, high frequency EMI is involved, making the direct driving impossible.

An external line memory may be provided in the conventional data driver in order to reduce frequency into half through bisected driving or driving by ICS. In this case, however, the cost as well as the weight of the product increase due to the line memory. Accordingly, power consumption and volume are also increased.

SUMMARY OF THE INVENTION

The present invention has been made in view of the above circumstances and has an object to overcome the problems and disadvantages of the prior art.

It is another object of the present invention to provide a data driver for a liquid crystal display in which the main driving frequency is reduced and overcomes problems caused due to operation at high frequency.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the data driver of the present invention includes a first signal generation circuit for externally producing a start signal; a second signal generation circuit for externally producing a first clock signal; a third signal generation circuit for externally producing a load signal; means for externally generating a source video signal having a frequency; and a single integrated circuit. The single integrated circuit including an m-bit register circuit for receiving the start signal corresponding to the first clock signal and outputting a latch clock signal, where m is an integer; a data latch circuit for latching and outputting at least two sets of three video signals corresponding to the source video signal, the data latch circuit receiving all of the video signals simultaneously, each of the video signals having n-bits of data, where n is an integer; a line latch circuit for latching the video signals from the data latch circuit corresponding to the latch clock signal from the shift register, the line latch circuit storing and outputting the video signal according to the load signal of the third signal generation circuit; a digital to analog converter circuit for converting the video signal from the line latch to an analog signal; and a data output circuit for outputting the analog signal from the digital to analog converter, wherein a frequency of the first clock signal is reduced by the number of sets of the three video signals as compared to the frequency of the source video signal.

In another aspect of the present invention, a data driver for a liquid crystal display includes a first signal generation circuit for externally producing a source start signal; a second signal generation circuit for externally producing a first clock signal; a third signal generation circuit for externally producing a load signal; a fourth signal generation circuit for externally producing a polarity signal; and a single integrated circuit. The signal integrated circuit includes an m-bit register circuit for shifting the source start signal corresponding to the first clock signal and outputting a latch clock signal; a data latch circuit for latching and outputting at least two sets of three video signals, the data latch circuit receiving all of the video signals simultaneously, each set representing a pixel in the liquid crystal display, each of the video signals having n-bits of data, where n is an integer; a 3m×n line latch circuit for latching the video signals from the data latch corresponding to the latch clock signal from the shift register, the line latch circuit storing and outputting the video signal according to the load signal of the third signal generation circuit; a polarity inversion circuit for inverting a polarity of the video signals from the data latch; a digital to analog converter circuit for converting the video signal from the line latch to an analog signal; and a data output circuit for outputting a signal from the digital to analog converter, wherein a driving frequency of the data driver is reduced by the number of sets of the three video signals.

In a further aspect of the present invention, a data driver for a liquid crystal display includes a first signal generation circuit for externally producing a source start signal; a second signal generation circuit for externally producing a first clock signal; a third signal generation circuit for externally producing a load signal; a fourth signal generation circuit for externally producing a polarity signal; and a single integrated circuit. The single integrated circuit includes a register circuit for shifting the source start signal corresponding to the first clock signal and outputting a sampling clock signal; a data sampling circuit for sampling and outputting at least two sets of three video signals, the data sampling circuit receiving all of the video signals simultaneously, each set representing a pixel in the liquid crystal display; a 3m×n line latch circuit for latching the video signals from the data latch corresponding to the latch clock signal from the shift register, the line latch circuit storing and outputting the video signal according to the load signal of the third signal generation circuit; a polarity inversion circuit for inverting a polarity of the video signals from the data latch; a digital to analog converter circuit for converting the video signal from the line latch to an analog signal; and a data output circuit for outputting a signal from the digital to analog converter, wherein a driving frequency of the data driver is reduced by the number of sets of the three video signals.

BRIEF DESCRIPTION OF THE ATTACHED DRAWINGS

The accompanying drawings, which are incorporated in and constitute a part of this specification, illustrate embodiments of the invention and, together with the description, serve to explain the objects, advantages and principles of the invention.

DETAILED DESCRIPTION OF THE INVENTION

Reference will now be made in detail to the preferred embodiments of the invention, examples of which are illustrated in the accompanying drawings. Wherever possible, the same reference numbers will be used throughout the drawings to refer to the same or like parts.

A data driver for a liquid crystal display of the present invention includes an m-bit shift register for shifting a source start pulse by a source pulse clock, and outputting a latch clock. A plurality of data latches latch and output three signals of divided n-bit display data and N 3m-by-n-bit line latches latch all display data of one horizontal line output from the respective data latches by the latch clock output from the shift register and store and output the data according to an external load signal. A line conversion logic converts the polarity for every horizontal period by an external POL signal and N D/A converters convert the data output from the respective line latches to an analog signal. N data output circuits amplify the signal output from the respective D/A converters, and apply the amplified signal to liquid crystal.

Figure 5:
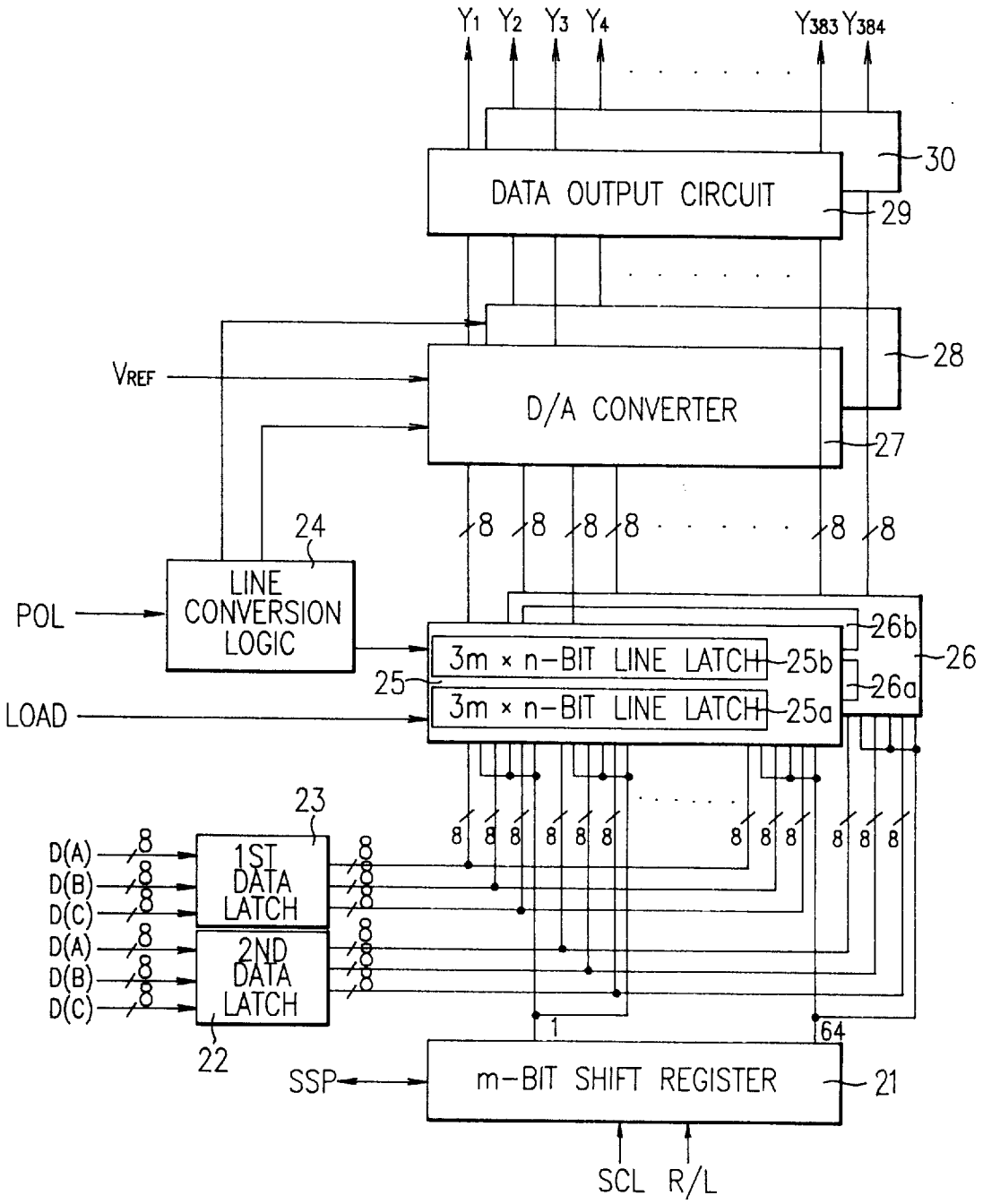
FIG. 5 is a block diagram of a first embodiment of data driver for a liquid crystal display according to the present invention.
Figure 7:
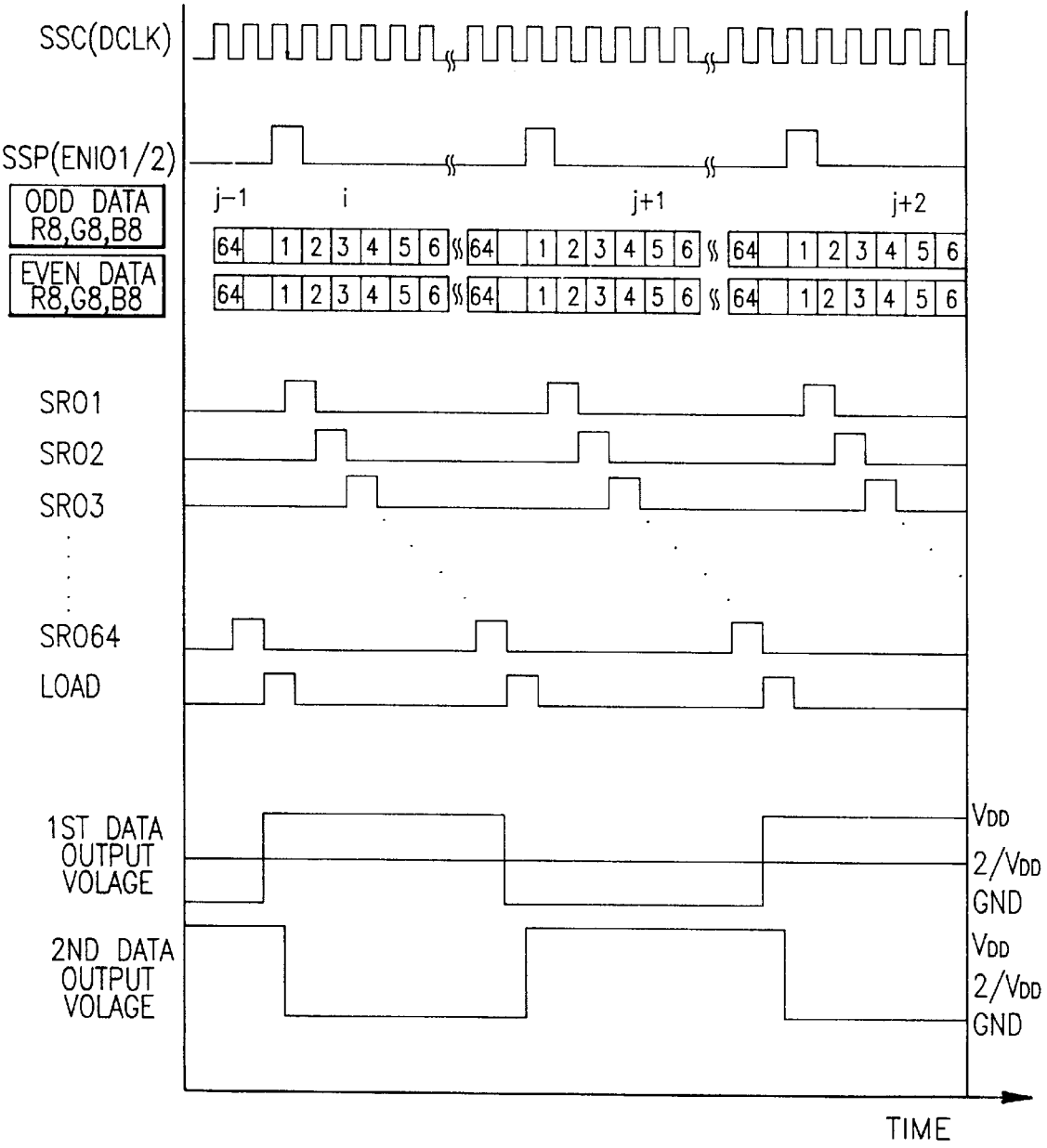
FIG. 7 is a timing diagram of the first embodiment of the data driver according to the present invention.

FIG. 5 is a diagram of an IC structure of the first embodiment of the present invention in which data to be applied to the even and odd portions of a data line is divided and processed in parallel. Hence, the operation frequency of the data driver is reduced by one-half. FIG. 7 is an operation wave form thereof.

As shown in FIG. 5, an m-bit shift register 21 receives source clock SCL which is one-half the operation frequency. Latch pulses SR01, SR02, . . . of FIG. 7 are produced by the source clock and source start pulse SSP. The R/L input is for shift left or right. Data divided into even and odd portions externally from the drive IC is latched in first and second data latches 22 and 23. Three signals of the n-bit odd data and three signals of the even data latched by first and second latches 22 and 23 are latched to 3m-by-n bit odd-line first latch 25*a* and even-line first latch 26*a* by the latch pulse of shift register 21.

One horizontal line of display data stored in first line latches 25*a* and 26*a* is stored in odd and even second line latches 25*b* and 26*b* at one time of the LOAD signal. At the same time, the next line data is sequentially latched to first line latches 25*a* and 26*a* by the latch pulse of the shift register 21. The line data stored in the odd and even second line latches 25*b* and 26*b* selects a corresponding voltage of two reference voltages by D/A converters 27 and 28. Here, line conversion logic 24 converts the voltage's polarity so as to facilitate inversion.

The selected reference voltage is applied to liquid crystal as a stable voltage having a sufficient driving capability and less-deviation output voltage through data output circuits 29 and 30. In this embodiment, data may be stored in first and second latches 22 and 23 in the arriving sequence. The output ports of data output circuits 29 and 30 being connected to the data line of the liquid crystal panel alternately by three.

Figure 6:
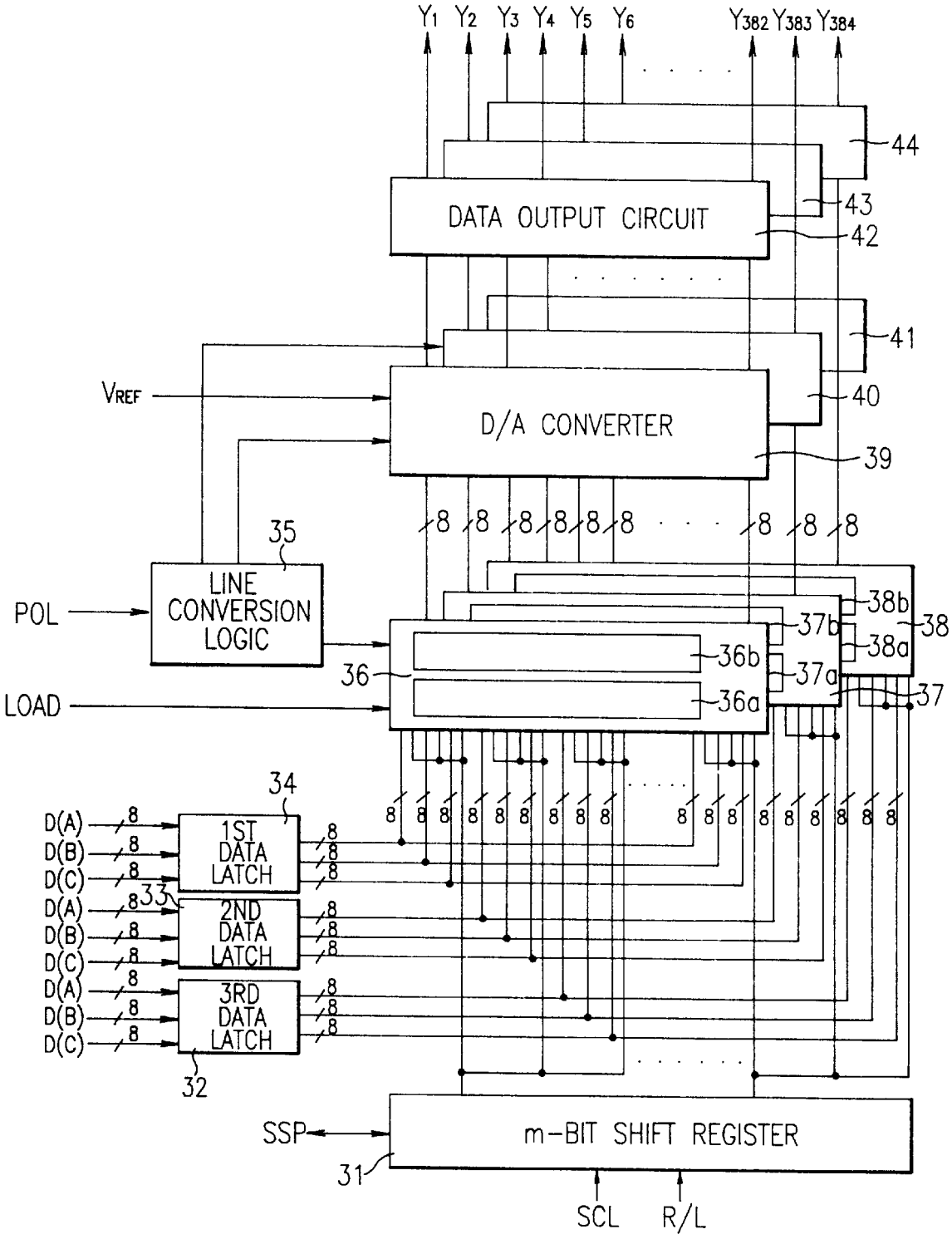
FIG. 6 is a block diagram of a second embodiment of a data driver for a liquid crystal display according to the present invention.

Referring to FIG. 6, unlike the first embodiment in which data is divided into odd and even portions, the second embodiment has three data latches 32, 33, and 34. Data is divided in such a manner that the data of the first data line is applied to the first latch 32, the data of the second data line is applied to the second latch 33, and the data of the third data line is applied to the third latch 34. The data of the fourth, fifth, and sixth data lines is applied to the first, second, and third latches. Shift register 31 applies one third the frequency of the case of nonparallel driving, thus reducing the operation frequency of the data drive IC by one-third. Other operations are similar to that of the first embodiment.

Figure 1:
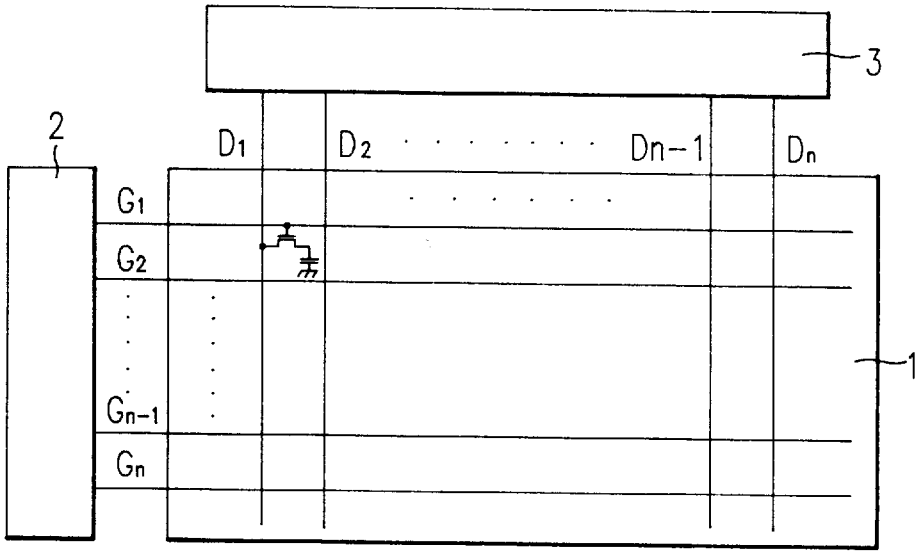
FIG.1 prior art
FIG. 1 is a block diagram of a liquid crystal display.
Figure 2:
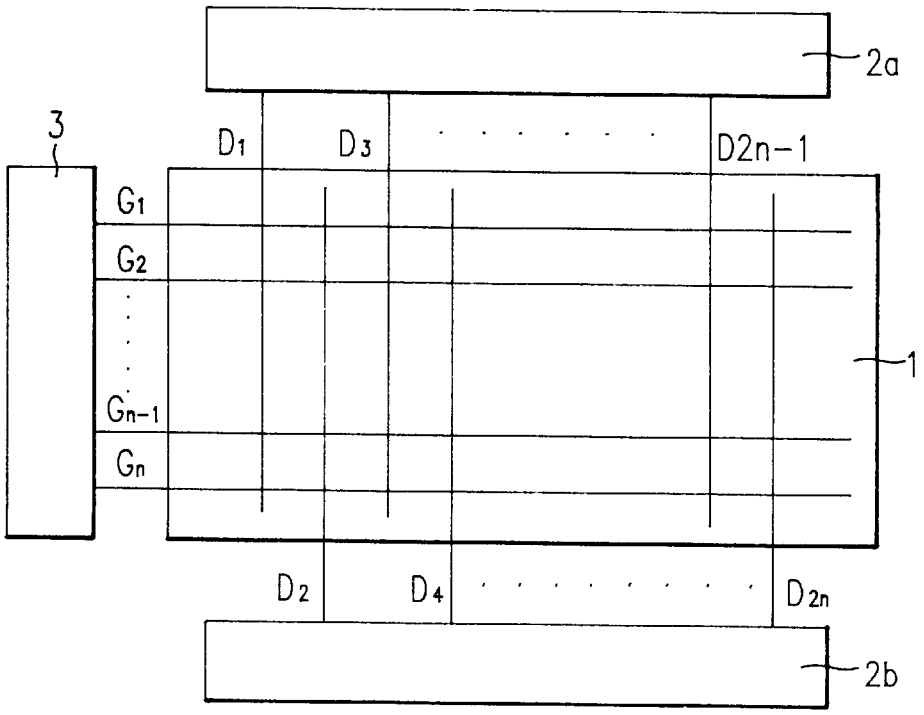
FIG.2 prior art
FIG. 2 is a block diagram of a liquid crystal display having a double-driver.
Figure 3:
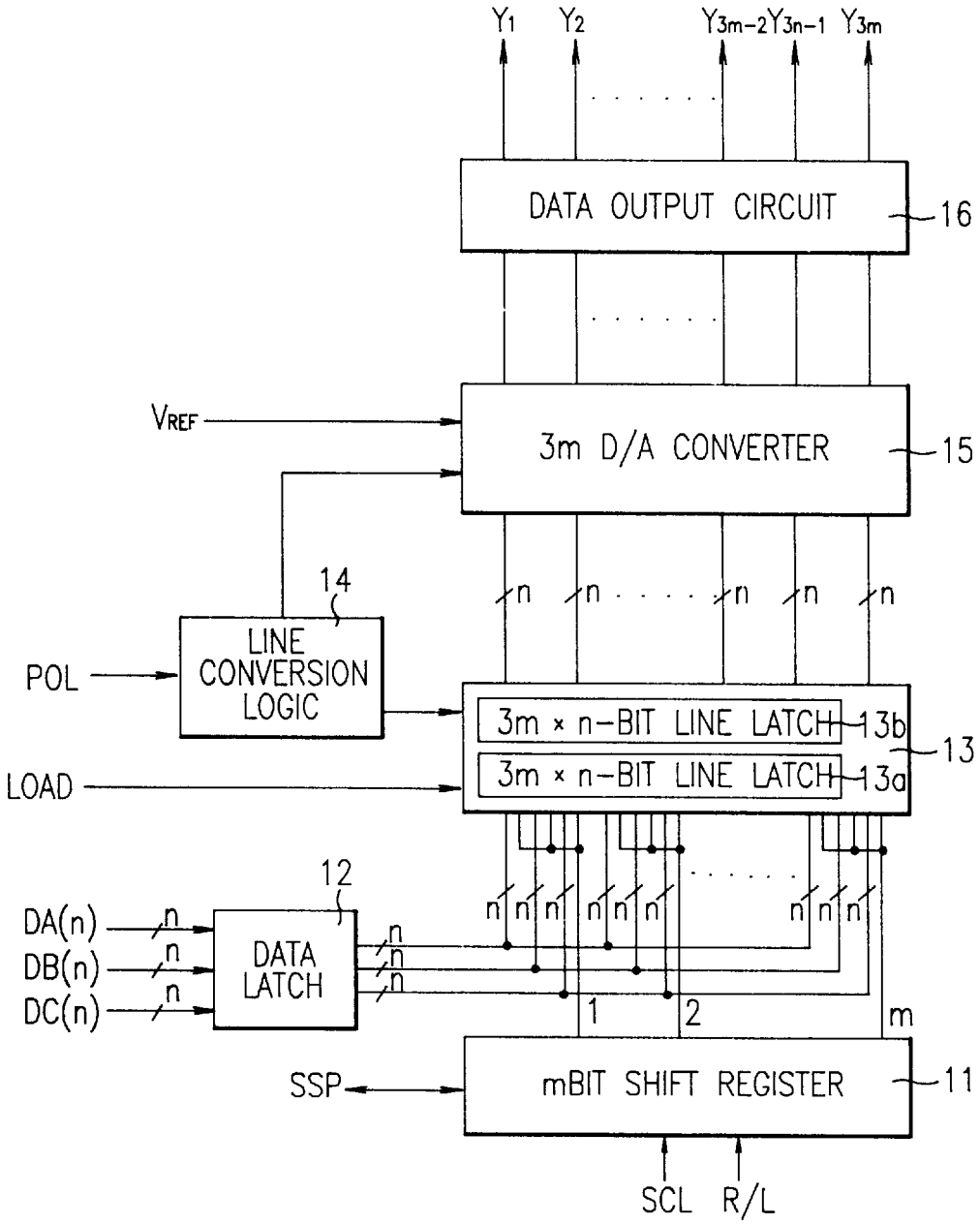
FIG.3 prior art
FIG. 3 is a block diagram of a data driver of a conventional liquid crystal display.
Figure 4:
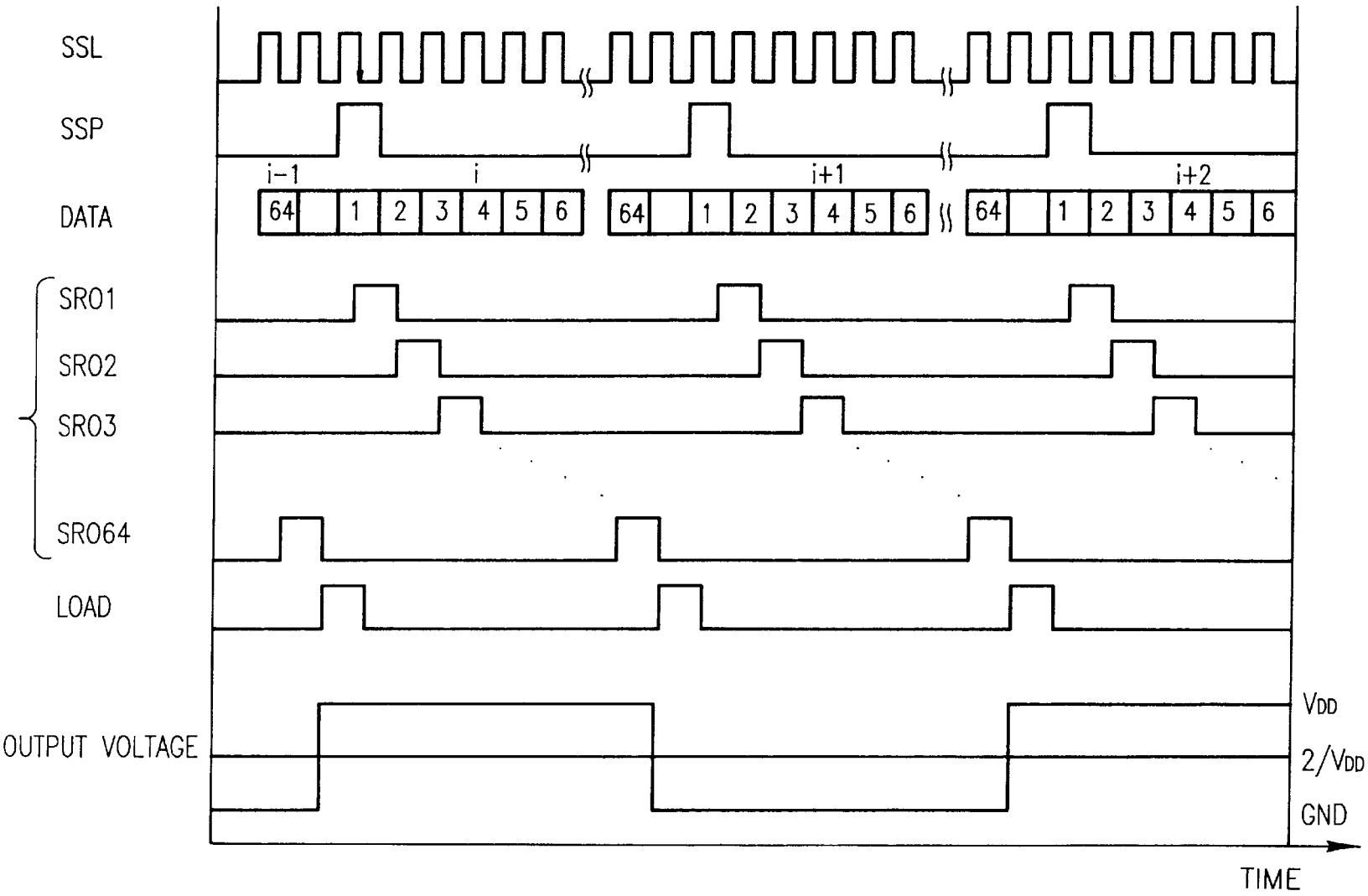
FIG. 4 is a timing diagram of the driver shown in FIG. 3.

In the first and second embodiments, the data driver is attached only to one side of the liquid crystal panel. However, when this driver is formed in a double structure as shown in FIG. 2, the main driving frequency is further reduced by one-half.

Accordingly, in the present invention, a plurality of components of the conventional data driver are disposed in a single IC and operate in parallel, allowing the clock frequency to be reduced as compared with conventional circuits.

The data driver of the liquid crystal display of the present invention has the following advantages. The present invention reduces the main driving frequency by one-half or one-third in the driver itself, eliminating the need for an external memory and circuit. Therefore, the present invention is suitable for a module protected against high-frequency EMI, decreasing cost, weight, volume, and power consumption. Furthermore, XGA or EWS resolution can be obtained in a single or double structure in laptop computers or monitors.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A data driver comprising:

a first signal generating circuit for externally producing a start signal;

a second signal generating circuit for externally producing a first clock signal;

a third signal generating circuit for externally producing a load signal;

means for externally generating a source video signal having a frequency; and a single integrated circuit including:

an m-bit register circuit for receiving the start signal corresponding to the first clock signal and outputting a latch clock signal, where m is an integer;

a data latch circuit for latching and outputting a first set of three video signals of odd data and a second set of three video signals of even data corresponding to the source video signal, the data latch circuit receiving all of the video signals simultaneously, each of the video signals having n-bits of data, where n is an integer;

a line latch circuit including a first latch unit and a second latch unit for latching the video signals from the data latch circuit corresponding to the latch clock signal from the shift register, the line latch circuit storing and outputting the video signals according to the load signal of the third signal generation circuit, the first latch unit including first and second odd line latches and the second latch unit including first and second even line latches the first odd line latch receiving the first set of the three video signals and the first even line latch receiving the second set of the three video signals, wherein one horizontal line of display data stored in the first odd and even line latches is stored in the second odd and even line latches in response to the load signal;

a digital to analog converter circuit for converting the video signal from the line latch to an analog signal; and a data output circuit for outputting the analog signal from the digital to analog converter, where a frequency of the first clock signal is reduced by the number of sets of the three video signals as compared to a frequency of the source video signal.

2. A data driver according to claim 1, wherein the m-bit register circuit includes a shift register.

3. A data driver according to claim 1, further comprising:

a fourth signal generation circuit for externally producing a polarity signal; and a polarity inversion circuit for inverting a polarity of the video signals from the data latch.

4. A data driver according to claim 3, wherein the m-bit shift register circuit, the data latch circuit, the line latch circuit, the digital to analog converter circuit, the data output circuit, and the polarity inversion circuit are included in a single integrated circuit.

5. A data driver according to claim 1, wherein at least two sets of the video signals correspond to first and second pixels.

6. A data driver according to claim 1, wherein the data latch circuit includes at least two data latches.

7. A data driver according to claim 1, wherein the line latch circuit includes at least two 3m×n line latches.

8. A data driver according to claim 1, wherein the digital to analog converter circuit includes at least two digital to analog converters.

9. A data driver according to claim 1, wherein the line latch circuits each include at least two line memories.

10. A data driver according to claim 1, wherein the data latch circuit includes at least three data latches each of the data latches latching and outputting three video signals, each of the video signals having n-bits of data, where n is an integer.

11. A data driver for a liquid crystal display comprising:

a first signal generating circuit for externally producing a source start signal;

a second signal generating circuit for externally producing a first clock signal;

a third signal generating circuit for externally producing a load signal;

a fourth signal generating circuit for externally producing a polarity signal; and a single integrated circuit including:

an m-bit register circuit for shifting the source start signal corresponding to the first clock signal and outputting a latch clock signal, where m is an integer;

a data latch circuit for latching and outputting a first set of three video signals of odd data and a second set of three video signals of even data, the data latch circuit receiving all of the video signals simultaneously, each set representing a pixel in the liquid crystal display, each of the video signals having n-bits of data, where n is an integer;

a 3m×n line latch circuit including a first latch unit and a second latch unit for latching the video signals from the data latch circuit corresponding to the latch clock signal from the shift register, the line latch circuit storing and outputting the video signals according to the load signal of the third signal generation circuit, the first latch unit including first and second odd line latches and the second latch unit including first and second even line latches, the first odd line latch receiving the first set of the three video signals and the first even line latch receiving the second set of the three video signals, wherein one horizontal line of display data stored in the first odd and even line latches is stored in the second odd and even line latches in response to the load signal;

a polarity inversion circuit for inverting a polarity of the video signals from the data latch circuit; and a digital to analog converter circuit for converting the video signal from the line latch circuit to an analog signal; and a data output circuit for outputting a signal from the digital to analog converter, wherein a driving frequency of the data driver corresponds to the number of sets of the three video signals.

12. A data driver according to claim 11, wherein the n-bit video signal is divided into odd and even bits.

13. A data driver according to claim 11, wherein the data latch circuit includes at least two data latches.

14. A data driver according to claim 11, wherein the line latch circuit includes at least two 3m×n line latches.

15. A data driver according to claim 11, wherein the digital to analog converter circuit includes at least two digital to analog converters.

16. A data driver according to claim 11, wherein the line latch circuits each includes at least two line memories.

17. A driver according to claim 11, wherein the data latch circuit includes three data latches, each of the data latches latching and outputting three video signals, each of the video signals having n-bits of data, where n is an integer.

18. A data driver according to claim 11, further including a second data driver, the two data drivers driving the liquid crystal display further reduce the driving frequency by two.

19. A data driver according to claim 11, wherein the three video signals represent R, G, and B values for each pixel.

20. A data driver for a liquid crystal display comprising:

a first signal generating circuit for externally producing a source start signal;

a second signal generating circuit for externally producing a first clock signal;

a third signal generating circuit for externally producing a load signal;

a fourth signal generating circuit for externally producing a polarity signal; and a single integrated circuit including:

a register circuit for shifting the source start signal corresponding to the first clock signal and outputting a sampling clock signal;

a data sampling circuit for sampling and outputting a first set of three video signals of odd data and a second set of three video signals of even data, the data sampling circuit receiving all of the video signals simultaneously, each set representing a pixel in the liquid crystal display;

a 3m×n line latch circuit including a first latch unit and a second latch unit for latching the video signals from the data sampling circuit corresponding to the sampling clock signal from the register, the line latch circuit storing and outputting the video signal according to the load signal of the third signal generation circuit, the first latch unit including first and second odd line latches and the second latch unit including first and second even line latches, the first odd line latch receiving the first set of the three video signals and the first even line latch receiving the second set of the three video signals, wherein one horizontal line of display data stored in the first odd and even line latches is stored in the second odd and even line latches in response to the load signal;

a polarity inversion circuit for inverting a polarity of the video signals from the data sampling circuit; and a digital to analog converter circuit for converting the video signal from the line latch circuit to an analog signal; and a data output circuit for outputting a signal from the digital to analog converter, wherein a driving frequency of the data driver corresponds to the number of sets of the three video signals.

* * * * *